US005485695A

United States Patent [19]

Glock

[11] Patent Number: 5,485,695

[45] Date of Patent: Jan. 23, 1996

[54] LASER AIMING DEVICE

[76] Inventor: Gaston Glock, Hausfeldstrasse 17, A-2232 Deutsch Wagram, Austria

[21] Appl. No.: 309,038

[22] Filed: Sep. 20, 1994

[30] Foreign Application Priority Data

Sep. 21, 1993 [AT] Austria ..... 1906/93

[51] Int. Cl.[6] ..... F41G 1/34

[52] U.S. Cl. ..... 42/103; 362/113

[58] Field of Search ..... 42/103; 362/110, 362/113, 114

[56] References Cited

U.S. PATENT DOCUMENTS

| | | | |
|---|---|---|---|
| 1,055,147 | 3/1913 | De Marais | 362/114 |
| 1,088,502 | 2/1914 | Williams | 362/114 |
| 4,856,218 | 8/1989 | Reynolds, Jr. | 42/103 |
| 5,107,612 | 4/1992 | Bechtel | 42/103 |

FOREIGN PATENT DOCUMENTS 3021667 12/1980 Germany .

OTHER PUBLICATIONS

"Lasersight Special" Alpec Team (Date unknown).

Laser Devices, Inc. (Date unknown) "On Target".

*Primary Examiner*—Stephen M. Johnson

*Attorney, Agent, or Firm*—Jones & Asksew

[57] ABSTRACT

A laser sighting device for portable firearms having the switch (10) of the sighting device arranged on or in the trigger handle (12) within the region of the trigger (16). A preferred embodiment suggests that the switch (10) comprises a springable actuation element (10a) actuated by one of the fingers. The invention additionally pertains to a grip for a portable firearm into which the sighting device according to the invention is integrated.

5 Claims, 5 Drawing Sheets

LASER AIMING DEVICE

Figure 1:
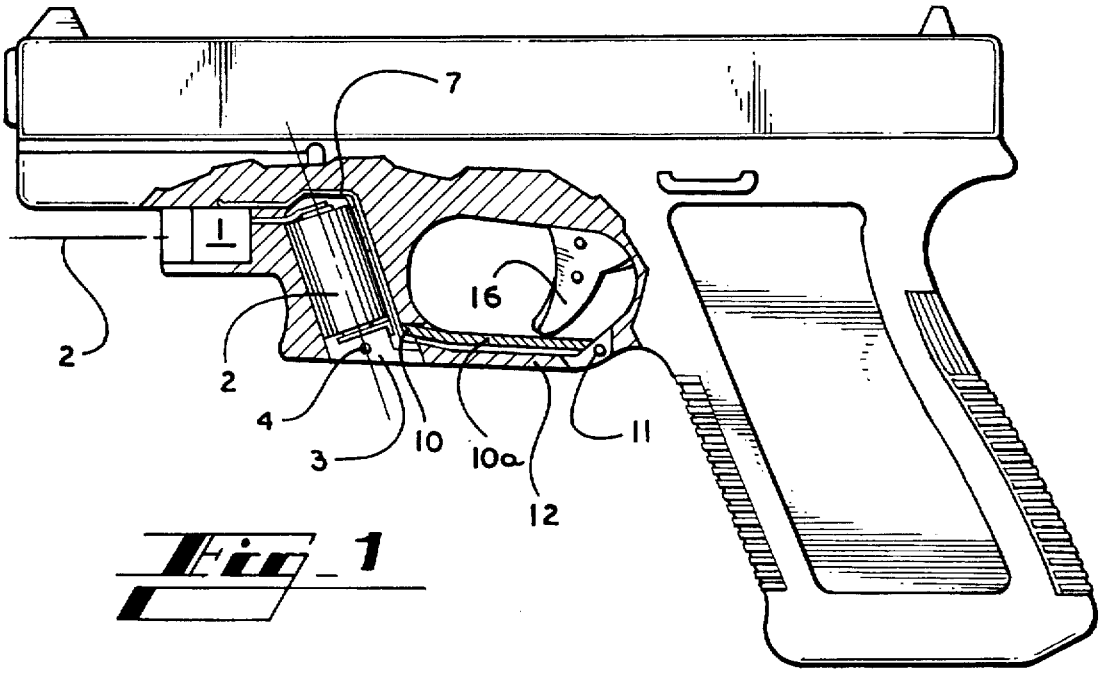

The invention pertains to a laser sighting device for portable firearms, e.g., pistols or rifles, whereby the switch of the sighting device is arranged within the region of the trigger.

Laser sighting devices of this type are generally known. One such laser sighting device for pistols is distributed by the firm APLEC TEAM, INCORPORATED.

This known sighting device consists of a laser unit with an integrated battery and a control button which is connected with the laser unit via a cable and fastened, e.g., bonded, onto the grip of the weapon, where it may be actuated by one of the fingers which encompass the grip.

One disadvantage of this device with respect to the reliability of the weapon under rough conditions can be seen in the fact that it is necessary to guide a cable along the outside of the housing of the weapon. In addition, it is necessary, even for experienced marksmen, that the grip and/or the thickness of the grip as well as the position of the fingers must be changed during the sighting process in order to turn on the laser.

A different type of sighting device which is also designed for a pistol is equipped with a switch that is arranged on the device itself. However, this particular sighting device requires a special type of handling of the weapon so as to switch the sighting device on and off. Consequently, this sighting device is considered extremely disadvantageous.

There also exist other devices of this type which are designed for pistols, e.g., the device distributed by the firm Laser Devices, Inc., in which the laser is mounted on top of the barrel. This particular design requires a mounting aid Which extends to the frame of the pistol around the moveable sled.

This device also is actuated by a switch that is arranged on the grip of the weapon and, in this particular instance, designed as a large-surface switch, so that not the position of the fingers, but rather the pressure of the hand must be changed in order to actuate the laser. However, the connection between the switch and the laser also is realized via a cable, as is the case with the first-mentioned device.

A laser sighting device of this type for rifles is known from German Patent No. A 3,021,667. Here, the switch is combined with the trigger of the firearm or at least arranged in series with said trigger. This is entirely unacceptable with respect to the safety requirements because there is a danger of the marksman unintentionally firing a shot while attempting to switch on the laser sighting device.

The invention is based on the objective of eliminating the disadvantages of these known devices and creating a laser sighting device in which the customary routine of the marksman is changed as little as possible while firing so as to not impair the marksman's attention and concentration. In addition, the cable routing between the switch and the laser should be eliminated or at least reduced to a minimum. According to safety regulations, it must also be insured that the weapon may not be fired unintentionally when switching on the laser sighting device.

According to the invention, these objectives are attained by the fact that the switch of the sighting device is arranged on or in the trigger handle. This measure facilitates the actuation of the switch in the simplest possible fashion without requiring that one finger must contact the trigger of the weapon or carry out a partial movement of the trigger.

The term trigger guard used in the description and the claims refers to the region which is located underneath and in front of the trigger as well as the region of the grip of the weapon which is situated on top and behind the trigger. The switch may be arranged either in the lower or the upper region of the trigger guard.

According to one preferred embodiment which, in particular, is designed for pistols, it is suggested that the sighting device be arranged in conventional fashion beneath the barrel of the weapon and in front of as well as adjacent to the trigger guard. This measure eliminates the cabling, which is susceptible to defects, or at least reduces said cabling to a minimum.

According to one advantageous embodiment of the invention, the switch comprises a springable contact which is closed by one finger. This measure facilitates that the marksman may switch on the sighting device and maintain said sighting device actuated by means of a minimal movement of the finger toward the top or the bottom, which is customary during a normal sighting process. The finger normally is the trigger finger, but the finger may also be a finger of the other hand if firing with both hands.

According to one preferred embodiment, the switch consists of a springable or spring-loaded oblong element which is integrated into the trigger guard essentially parallel to the barrel or such that it lies on said barrel and actuates the switch in the interior of the battery-laser unit once it is contacted by the finger, namely independently from the position of the finger in relation to the trigger. Here, the term "lying on" should not be understood in such a way that the element lies on the trigger guard in an immovable fashion, but rather in a movable fashion relative to the trigger guard between an "open position" and a "closed position."

Figure 2:
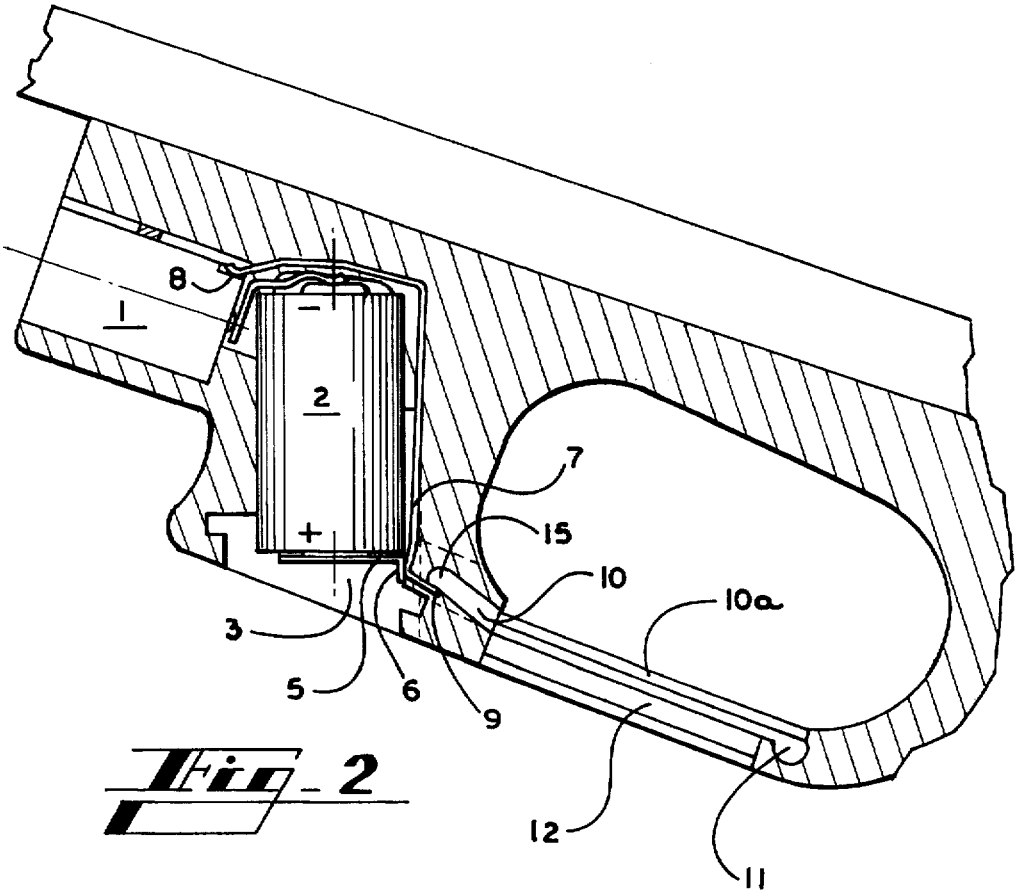
Figure 3:
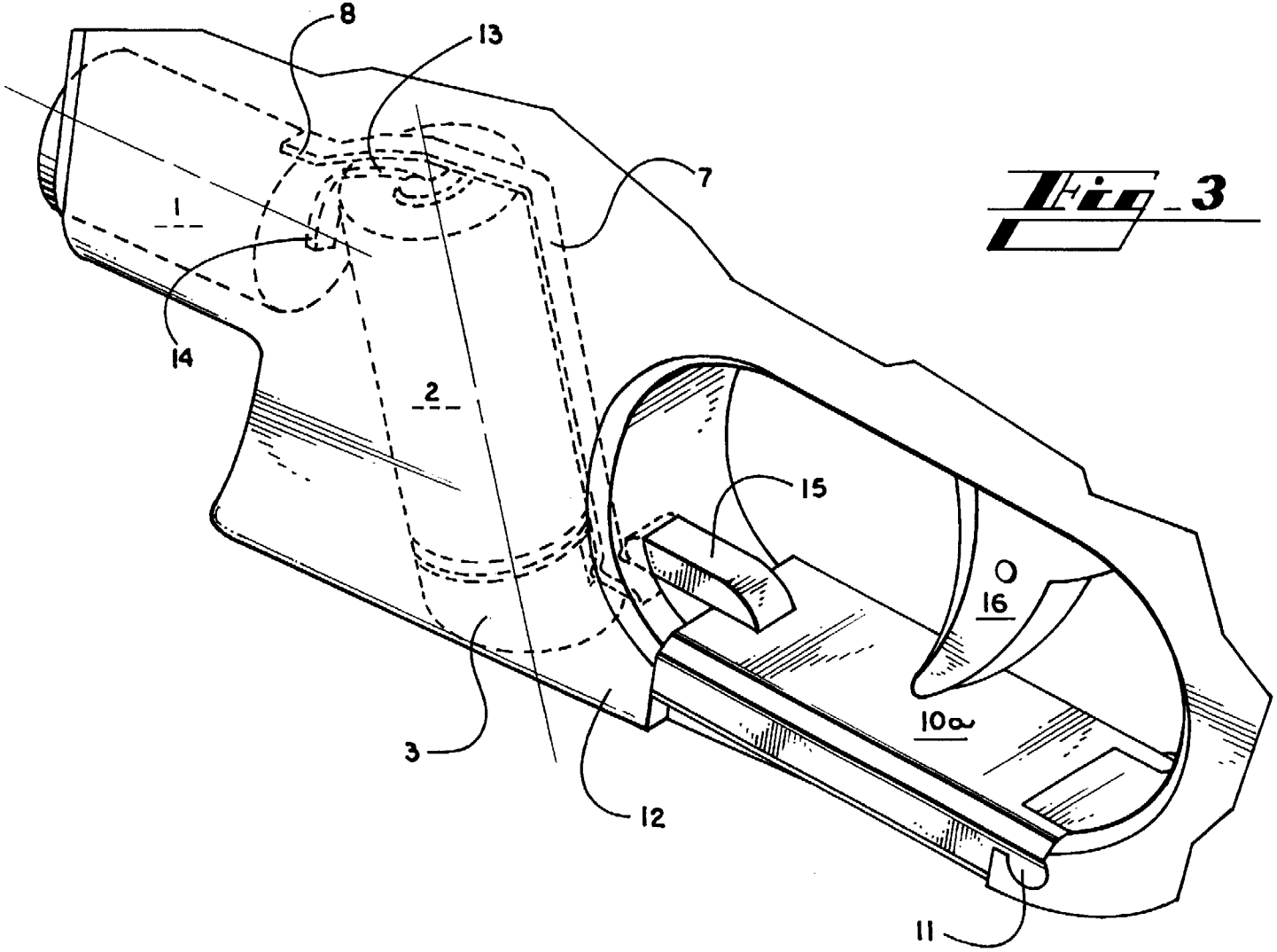
Figure 4:
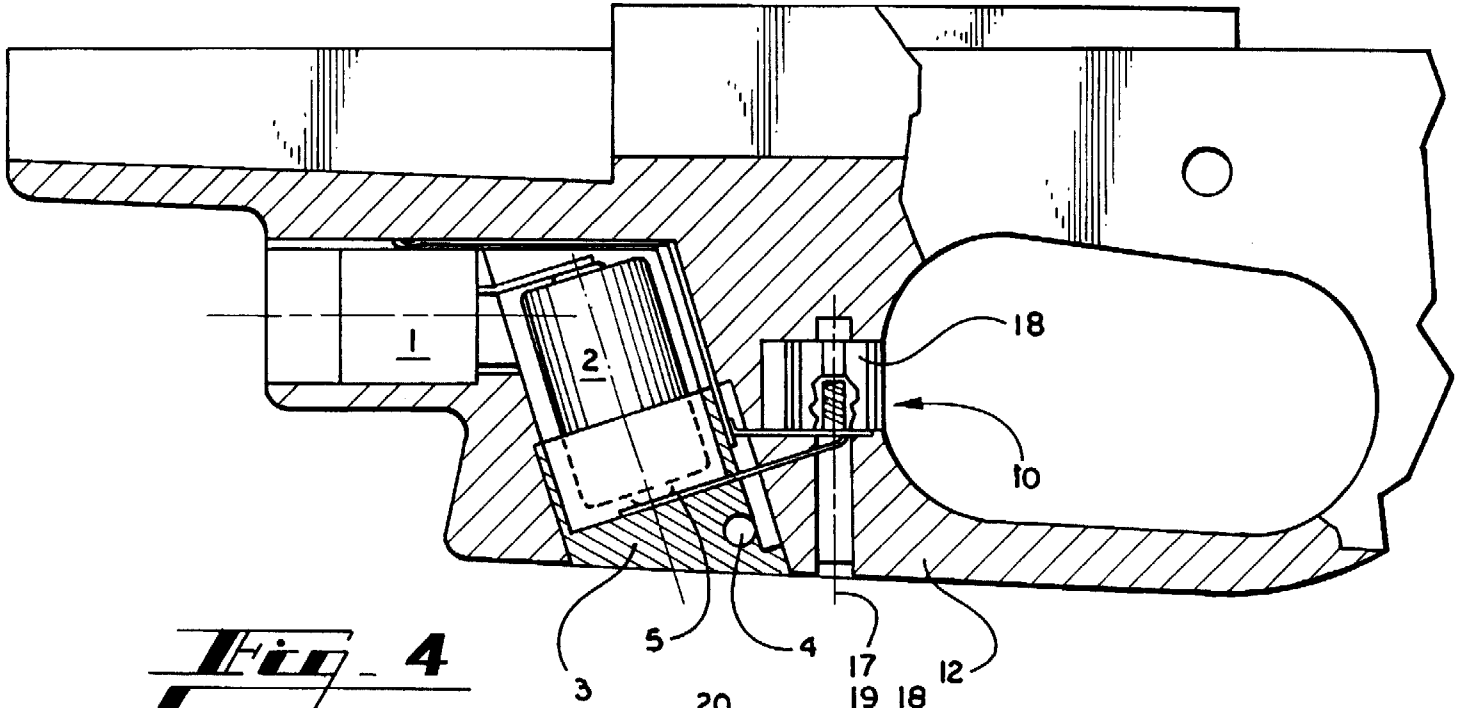
Figure 5:
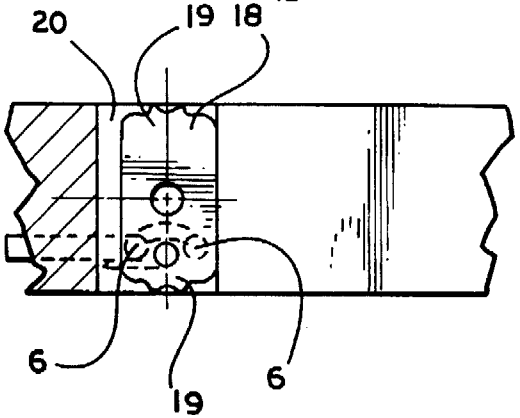

The invention is illustrated in detail in the figures. The figures show:

FIG. 1, a side view of a pistol which is equipped according to the invention, FIG. 2, an enlarged detail of one variation of the invention, FIG. 3, a transparent transverse view of a device according to FIG. 2, FIGS. 4 and 5, a variation of the device according to FIGS. 1 through 3, and FIGS. 6–8, a preferred variation of the device according to the invention.

Figure 9:
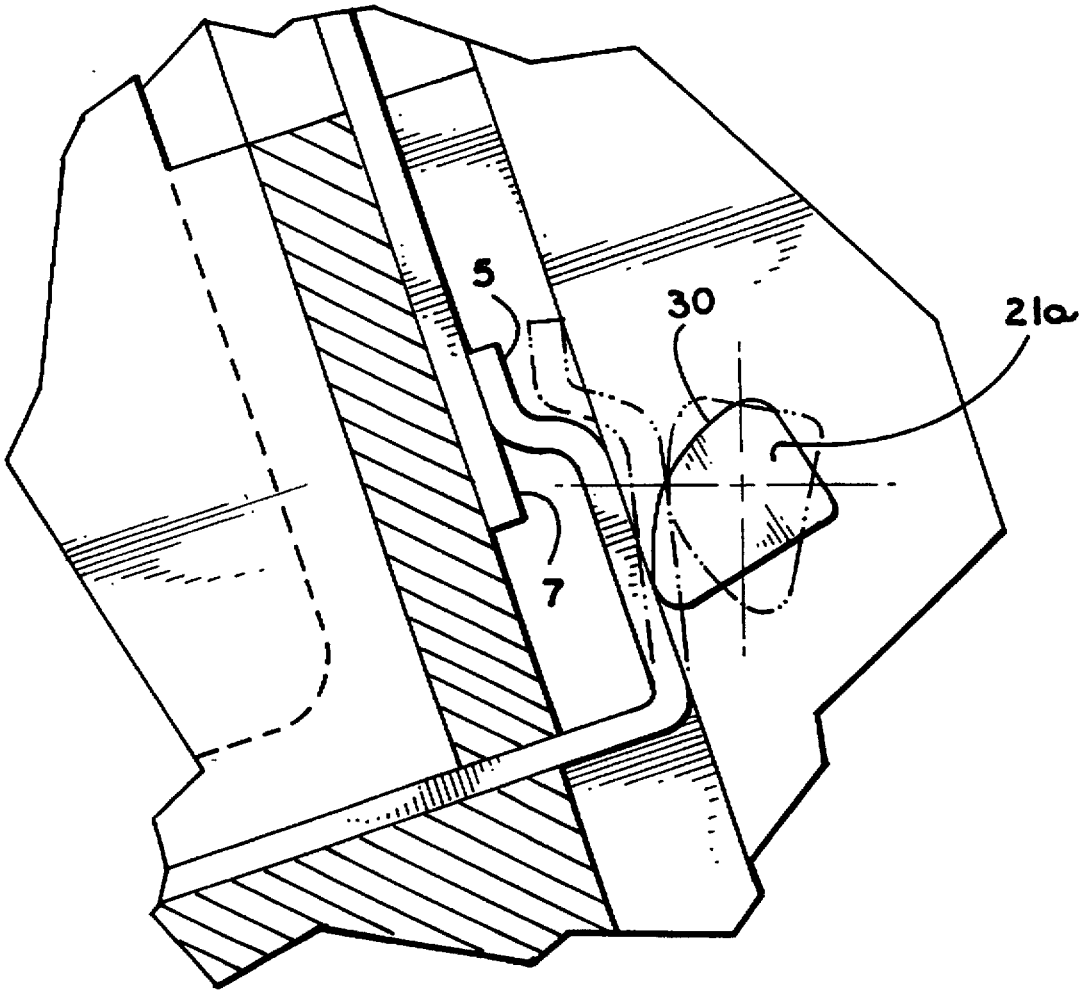

FIG. 9, another preferred variation of the device according to the invention.

In FIG. 1, a pistol equipped with a laser sighting device according to the invention is illustrated in a partially sectioned side view. The laser 1 emits a laser beam 2, which consists of visible light so as to simplify the sighting process.

The laser 1 receives its energy from a battery 2 which is arranged in a battery shaft and retained therein by means of a closure element 3. The closure element of the embodiment illustrated in FIG. 1 may be inserted into the battery shaft and closes said battery shaft toward the outside in an essentially smooth fashion. The closure element 3 is held in position by a pin 4, which penetrates through the side walls of the piston housing into the region of the closure element 3 and the closure element 3 itself, namely perpendicular to the central plane of the pistol which corresponds with the plane of projection.

The closure element 3 carries an electrically conducting component 5 (FIG. 2) on its side facing the battery, with said electrically conducting component equipped with a contact surface 6 on its rear end facing the trigger 16. A springable and/or spring-loaded electrical conductor 7, which is connected to the contact point 8 of the laser in an electrically conducting fashion, may cooperate with the contact surface 6.

The electrical conductor 7 has an actuating section 9 that acts upon the switch 10 in the region opposing the contact surface 6.

The switch 10 consists of a rod or plate which extends essentially parallel to the barrel of the pistol and is arranged in the pistol housing in a rotatable or springable fashion at the end 11 which is situated opposite the actuation region 9.

The design of the switch 10 in the direction toward the (not illustrated) finger of the user is constructed in such a way that the finger does not lie on the trigger guard 12, but rather on the switch 10, so the actuating path to close the contact 6 is short, and the actuation force required for this movement is small.

The variation illustrated in FIG. 2 essentially differs from the embodiment illustrated in FIG. 1 by the design of the closure element 3 that may be inserted into the direction extending perpendicular to the central plane of the piston due to the tongue and groove design illustrated in FIG. 2.

FIG. 3 shows an enlarged transverse view of the embodiment according to FIG. 1, where the individual components are only indicated by their contours such that the impression of a glass model is created. Here, the switch 10 is illustrated in the nonactuated as well as in the actuated position.

FIG. 3 clearly indicates that the part 10*a* of the switch 10 that comes in contact with the fingers has a width corresponding to the width of the trigger guard 12, so that the trigger finger always lies on the switch 10 and not on the trigger guard 12, even if the trigger finger is situated in a transverse position. This particular design allows a simple actuation of the switch 10 without having to place the finger into the trigger guard and consequently increases the safety of the weapon substantially.

In contrast to the embodiments described previously, it goes without saying that there are instances in which the sighting device may only be activated when the user is ready to fire the weapon. In this particular instance, it suffices to construct the part 10a with a width smaller than the width of the trigger guard 12.

The electrical cabling which is identical in all embodiments shown leads from the battery 2 to the corresponding contact 14 of the laser 1 through a short conductor 13 and from the battery 2 to the second electrical contact 8 of the laser 1 through the electrically conducting component 5 of the closure 3, the closed switch 6 and the electrical conductor 7.

One variation is illustrated in FIGS. 4 and 5. Here, the switch 10 consists of a lever 18 that may be pivoted around an axis 17 extending perpendicular to the barrel and located within the region of the central plane of the weapon, where said lever is accommodated in a transverse opening 20 of the frame of the weapon and/or the trigger guard 12. In the example shown, both ends 19 of the lever 18 are accessible to the user of the weapon, so that the device may be used for left-handed as well as right-handed persons.

During the course of pivoting the lever 18 around its axis 17, an electrical contact is closed, whereby it is irrelevant, as visible in FIG. 5, whether the lever 18 is pivoted into the respective transverse position (two contact surfaces 6) from its central position illustrated in the figure in the clockwise or counterclockwise direction. In the central position, the electrical contact is open and the surface is interrupted.

It goes without saying that it is possible to construct the lever 18 asymmetrically to the central plane of the weapon and/or accessible to the user on one side of the weapon, but this measure eliminates the advantage that left-handed as well as right-handed persons may use the weapon. In such an instance, it is not necessary to provide three switching positions, but it rather suffices to provide one "on" and one "off" position.

It is also possible to move the lever 18 in a sliding fashion instead of in a pivoting fashion, but the pivoting movement is preferred due to its simpler technical realization and the simpler actuation during the pivoting movement.

The variation illustrated in FIGS. 4 and 5 as well as its embodiments provide the advantage that the actuation of the laser is carried out without impairing the customary movement sequence during the sighting process and the firing process, but that this actuation is carried out entirely separate from the movement of the finger while actuating the trigger 16 (FIG. 3).

Figure 6:
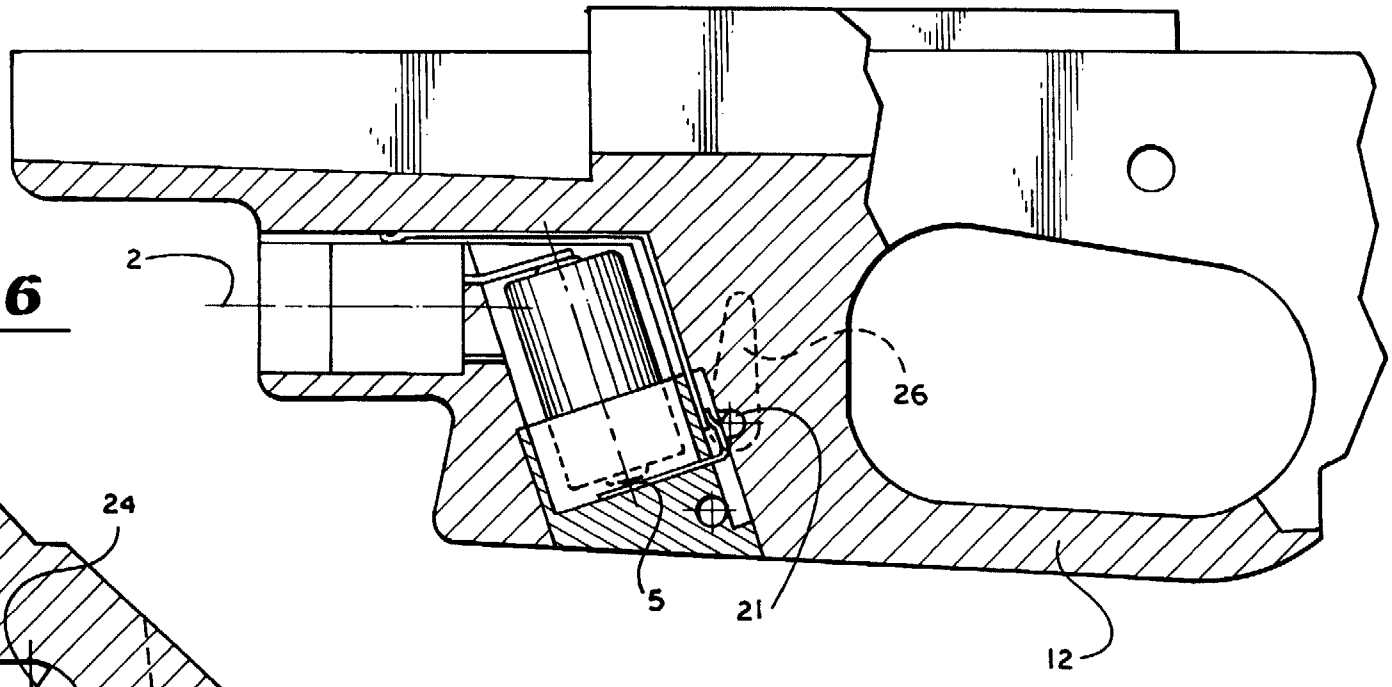
Figure 7:
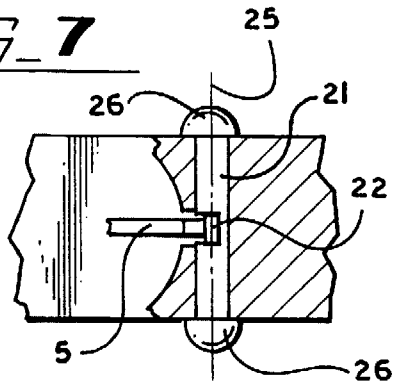
Figure 8:
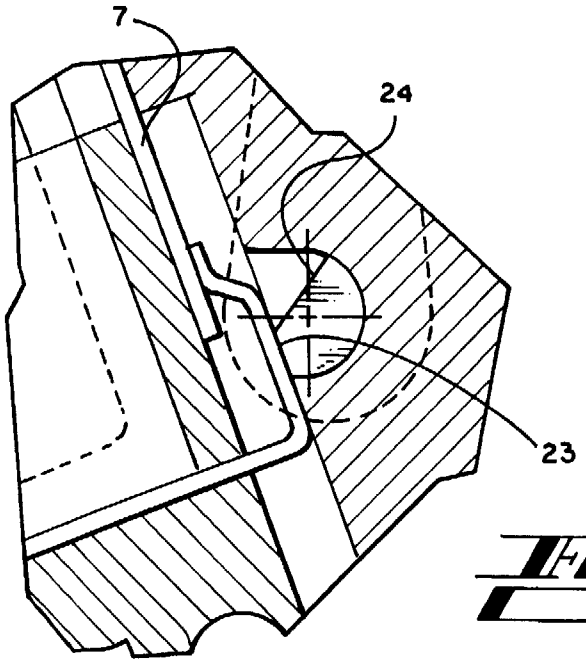

The preferred variation of the device according to the invention which is illustrated in FIGS. 6, 7 and 8 is constructed in a simple fashion and fulfills the initially mentioned safety requirements. The switch 10 is actuated by pivoting a bolt 21 with a cam-like surface 22.

In the examples shown, this surface has a first flattened region 23 which is situated at a larger distance from the pivoting axis 25 of the bolt 21 than a second flattened region 24. Depending on the angular position of the bolt 21, a contact between the two electrical conductors 5 and 7 is closed or interrupted by the flattened regions.

The pivoting of the bolt 21 is carried out by means of a pivoted lever 26 (illustrated in dotted-dashed lines in FIG. 6). It is preferable to arrange a pivoted lever 26 on each end of the bolt as shown in FIG. 7 so as to make the weapon suitable for left-handed as well as right-handed persons. The two pivoted levers 26 also serve for fixing the bolt 21 in the axial direction.

The embodiment shown is also considered to be particularly favorable due to the fact that it facilitates a "methodical" pulling of the trigger and sighting process: The trigger finger may remain outside of the trigger guard 12 as is required for safety reasons and contact the frame underneath the barrel. In order to switch on the laser, the pivoted lever 26 is moved backward during the course of the trigger movement without requiring that the trigger finger move into the proximity of the trigger (16 in FIG. 3) to switch on the laser.

In addition, the process of switching on the laser is carried out by moving a finger backward as is the case during the trigger movement, namely for right-handed as well as left-handed persons.

The cam-like surface 22 of the bolt 21 does not necessarily have to be constructed in the shape illustrated in the figures. It may consist of a spiral section with a continuously changing radius with respect to the axis 25 or of only one region which is situated closer to the axis 25 than the edge of the bolt.

It is essential that there exist at least one angular position of the bolt in which one of the two electrical conductors 5 or 7 is deformed in a springable fashion such that it comes in contact with the other electrical conductor, and that there exists at least one other angular position in which both conductors 5,7 do not contact each other.

If the bolt is provided with a cam surface 22 that has a first flattened region 23 and a second flattened region 24, the bolt is retained in the respective angular position between the pivot lever 26 and the trigger guard 12 by the spring force of the electrical conductor 5. If the cam surface 22 is constructed differently, the bolt is retained in the respective angular position by means of limit stops and/or catches. It is advantageous if it can be noticed that the respective angular position has been reached, e.g., by latching or overcoming a dead point.

The figures clearly indicate that all variations of the device according to the invention are constructed without cabling. FIG. 1 shows that the housing of the laser sighting device is constructed in one piece with the frame of the pistol as is the case when this sighting device is already installed during the manufacture of the pistol frame.

It goes without saying that it is also possible to manufacture this housing separately and fasten said housing onto the pistol frame, e.g., by means of screws or bonding. This only requires minute quantifications of the trigger guard 12 which must be provided with a receptacle for the end 11 of the switch 10 and an opening through which the actuation end 15 of the switch 10 penetrates.

The measures according to the invention create a laser sighting device that not only attains the initially mentioned objectives, but also is constructed in an exceptionally robust and compact fashion because there are no electrical connections that may be loosened, damaged or destroyed due to the repeated vibrations while firing the weapon and during the daily operation under rough conditions, e.g., when using the weapon as a police weapon.

It goes without saying that it is also possible to construct the part 10*a* of a weapon without a trigger guard in a more robust fashion, namely to construct this part as a type of triggering guard.

The battery shaft closure 3 facilitates the exchange of the batteries in all embodiments shown, in which the batteries may be exchanged in a simple and rapid fashion without a tool or by means of a pin ejector provided on many pistols.

One conceivable variation would be the complete integration of the sighting device into the weapon as is indicated by the hash marks in FIG. 1. In most weapons, this only requires an exchange of the guard part with the guides for the sled.

When using the sighting device according to the invention on a rifle, it goes without saying that it is also possible to arrange the sighting device on top of the barrel or on the front end of the shaft underneath the barrel due to the fact that it is frequently desirable to place the weapon onto a substructure during the sighting process. In this, the cabling preferably extends in the interior of the weapon, e.g., in the interior of the shaft.

I claim:

1. Laser sighting device for portable firearms, in which the sighting device includes a switch (10) that closes or opens a contact between two electrical conductors (5, 7) and is arranged within a region of it trigger guard (12) comprising:

the switch (10) is arranged in a front region of the trigger guard (12) and comprises a rotatable bolt (21) having a rotation axis that is arranged substantially perpendicular to an axis of a laser beam (2) associated with the laser sighting device:

the bolt (21) has a cam-like surface (22) such that the bolt deforms one of the two electrical conductors (5 or 7) in a resilient fashion in at least one angular position of the bolt in such a way that said one conductor (5 or 7) comes in contact with the other electrical conductor (7 or 5), and the electrical conductors (5, 7) do not contact each other at least in one other angular position of the bolt.

2. Laser sighting device according to claim 1, wherein the bolt (21) is pivoted between the angular positions by means of a pivot lever (26).

3. Laser sighting device according to claim 2, wherein the contact between the two electrical conductors (5, 7) is produced by moving the pivot lever 26 in a direction of movement of a trigger associated with the firearm.

4. Laser sighting device for portable firearms, in which the sighting device includes a switch (10) that closes or opens a contact between two electrical conductors (5, 7) and is arranged within region of a trigger guard (12) comprising:

the switch (10) is arranged in a front region of the trigger guard (12) and comprises a rotatable bolt (21) having a rotation axis that is arranged substantially perpendicular to an axis of a laser beam (2) associated with the laser sighting device;

the bolt (21 ) has a cam-like surface (22) such that the bolt deforms one of the two electrical conductors (5 or 7) in a resilient fashion in at least one angular position of the bolt in such a way that said one conductor (5 or 7) comes in contact with the other electrical conductor (7 or 5);

the electrical conductors (5, 7) do not contact each other at least in one other angular position of the bolt; and the cam-like surface (22) comprises a first flattened region (23) which is situated at a longer distance from the rotation axis (25) of the bolt (21) than a second flattened region (24) of the cam-like surface.

5. Laser sighting device for portable fireams, in which the sighting device includes a switch (10) that closes or opens a contact between two electrical conductors (5, 7) and is arranged within a region of a trigger guard (12), comprising:

the switch (10) is arranged in a front region of the trigger guard (12) and comprises a rotatable bolt (21) having a rotation axis that is arranged substantially perpendicular to an axis of a laser beam (2) associated with the laser sighting device;

the bolt (21 ) has a cam-like surface (22) such that the bolt deforms one of the two electrical conductors (5 or 7) in a resilient fashion in at least one angular position of the bolt in such a way that said one conductor (5 or 7) comes in contact with the other electrical conductor (7 or 5);

the electrical conductors (5, 7) do not contact each other at least in one other angular position of the bolt; and the cam-like surface (22) has a spiral cross section relative to the rotation axis (25) of the bolt (21 ).

* * * * *